US009949895B1

(12) United States Patent
Khalid

(10) Patent No.: US 9,949,895 B1
(45) **Date of Patent: *Apr. 24, 2018**

(54) MEDICATION COMPLIANCE ALERT DEVICE

(71) Applicant: NexPil Inc., Niles, IL (US)

(72) Inventor: Syed Khalid, Niles, IL (US)

(73) Assignee: NexPil Inc., Niles, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/334,115

(22) Filed: Oct. 25, 2016

Related U.S. Application Data

(63) Continuation of application No. 14/521,379, filed on Oct. 22, 2014, now Pat. No. 9,474,695.

(60) Provisional application No. 61/894,737, filed on Oct. 23, 2013.

(51) Int. Cl.

| | |
|---|---|
| ***G08B 1/08*** | (2006.01) |
| ***A61J 7/04*** | (2006.01) |
| ***A61J 1/14*** | (2006.01) |
| ***G08B 21/24*** | (2006.01) |

(52) U.S. Cl.

CPC ..... *A61J 7/0418* (2015.05); *A61J 1/1412* (2013.01); *A61J 7/04* (2013.01); *A61J 7/0409* (2013.01); *A61J 7/0436* (2015.05); *A61J 7/0454* (2015.05); *A61J 7/0472* (2013.01); *A61J 7/0481* (2013.01); *G08B 21/24* (2013.01); *A61J 2200/30* (2013.01); *A61J 2205/10* (2013.01); *A61J 2205/20* (2013.01); *A61J 2205/40* (2013.01); *A61J 2205/50* (2013.01); *A61J 2205/60* (2013.01); *A61J 2205/70* (2013.01)

(58) Field of Classification Search

CPC combination set(s) only.

See application file for complete search history.

(56) References Cited

U.S. PATENT DOCUMENTS

| | | | | |
|---|---|---|---|---|
| 7,715,277 | B2 * | 5/2010 | de la Huerga | A61J 1/1437 221/2 |
| 9,474,695 | B1 * | 10/2016 | Khalid | A61J 7/0409 |
| 2007/0016443 | A1 * | 1/2007 | Wachman | G06Q 50/22 705/2 |
| 2012/0038226 | A1 * | 2/2012 | Tran | G06F 19/3462 307/116 |
| 2013/0002795 | A1 * | 1/2013 | Shavelsky | A61J 7/04 348/14.01 |
| 2013/0030566 | A1 * | 1/2013 | Shavelsky | A61J 7/04 700/244 |

(Continued)

OTHER PUBLICATIONS

U.S. Appl. No. 14/521,379, "Non-Final Office Action," dated Dec. 21, 2015, 11 pages.

(Continued)

*Primary Examiner* — Travis Hunnings

(74) *Attorney, Agent, or Firm* — McDonnell Boehnen Hulbert & Berghoff LLP

(57) ABSTRACT

A device can include an alert mechanism and a detection mechanism. The alert mechanism can activate an alert for a user to take a medication from a target medication receptacle. The detection mechanism can detect a tag associated with a medication receptacle. Actions may be performed based on a correlation between the detected tag and the target medication receptacle, such as deactivating the alert based at least in part on detecting the tag associated with the target medication receptacle.

20 Claims, 3 Drawing Sheets

(56) References Cited

U.S. PATENT DOCUMENTS

| | | | | |
|---|---|---|---|---|
| 2013/0197693 | A1* | 8/2013 | Kamen | G06F 19/3418 700/244 |
| 2015/0283036 | A1* | 10/2015 | Aggarwal | A61J 7/04 206/534 |

OTHER PUBLICATIONS

U.S. Appl. No. 14/521,379, "Notice of Allowance," dated Jun. 23, 2016, 5 pages.

* cited by examiner

MEDICATION COMPLIANCE ALERT DEVICE

CROSS-REFERENCES TO RELATED APPLICATIONS

This application is a Continuation of U.S. application Ser. No. 14/521,379, filed Oct. 22, 2014, which application claims the benefit of U.S. Provisional Application No. 61/894,737, filed Oct. 23, 2013, the content of which is incorporated herein by reference in its entirety.

BACKGROUND

Every day, significant numbers of patients fail to take their medication as directed. Such non-compliance with prescription regimens can result in reduced efficacy of treatments, increased hospitalizations, and even death. Various approaches for promoting compliance have been developed, yet these approaches can fail in several ways.

For example, day-of-the-week or other pillbox organizers frequently require a user to transfer pills from an original container from a pharmacy into alternate containers that will be utilized to help the user remember when to take the pills. This process may introduce opportunities for error. Additionally, the extra burden of this process may become a potential promoter of non-compliance, especially for patients that lack the discipline or mental faculties to consistently complete the sorting and replenishing tasks.

With alarm or notification reminder systems, a patient who is not able to hear or see the notification will simply not be reminded, resulting in inadvertent non-compliance. Furthermore, alarms such as on wristwatches or phone applications may be easily turned off without actually prompting the patient to take the medication.

DETAILED DESCRIPTION OF THE INVENTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Embodiments disclosed herein are directed to medication compliance systems that include medication alert devices. A medication alert device can provide a reminder to a patient to take a medication. The medication alert device may indicate a medication receptacle (such as a pill bottle) that may contain the medication referenced in the reminder, such as by showing a shape and/or color indicia associated with the medication receptacle. The patient can select a medication receptacle and bring a cap or other feature of the medication receptacle near the medication alert device. The medication alert device can detect that the feature is nearby and determine which medication receptacle is detected. Based on the medication receptacle detected, the medication alert device can perform a variety of actions. For example, when the detected medication receptacle matches the medication referenced in the reminder, the medication alert device may provide a confirmation of the match. In a further example, detection of a medication receptacle may indicate that the patient has taken a dose of the medication associated with the receptacle, and the medication alert device may deactivate a reminder, such as turning off a shape and/or color indicia. In another example, a number of times that a receptacle has been detected may be used to estimate an amount of medication consumed or remaining for a particular receptacle. In yet another example, an amount of time between a reminder and a detection may be used to determine patterns of behavior and/or adjust timing of future reminders. In various embodiments, the medication alert device can communicate with other devices, such as to provide information about medication compliance to healthcare providers and/or to receive updates, such as changes to reminder schedules or organization of medication receptacles.

Figure 1:
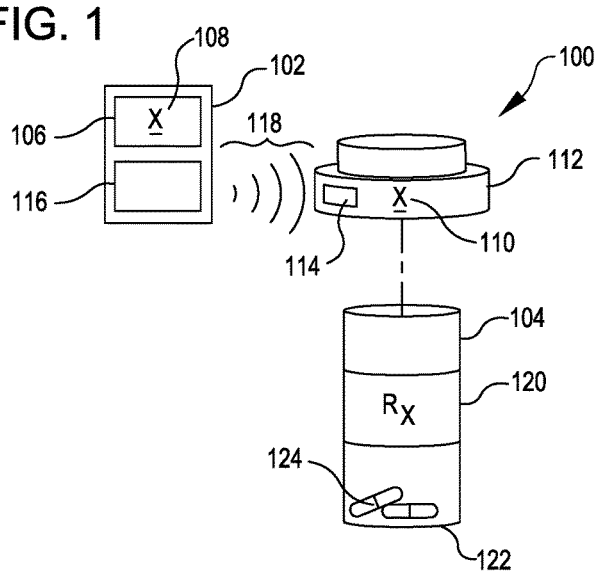
FIG. 1 is a schematic diagram showing an example of a medication compliance system in accordance with at least one embodiment.

Referring now to the drawings, in which like reference numerals represent like parts throughout the several views, FIG. 1 shows an example of a medication compliance system 100. The system 100 can include a medication alert device 102 and a medication receptacle 104.

The medication receptacle 104 may be a pill bottle or any other receptacle capable of containing medication 124. Although description herein primarily references pills, the disclosure is equally applicable to medication 124 of any kind, including, but not limited to, creams, ointments, syrups, serums, comestibles, or injectionables. The receptacle 104 may include a lid 112 that is removable to access medication 124 contained within a body 122 of the receptacle 104. The receptacle 104 may include a label 120 that identifies the medication intended to be contained in the receptacle 104.

The device 102 can come in a variety of forms. In some embodiments, the device is wearable by a user of the device. For example, the device may be incorporated into a wristband, a watch, a bracelet, a necklace, a ring, a garment, a headband, a belt, a pair of suspenders, a pair of glasses, a glove, a gauntlet, a girdle, a harness, a shoe, or an implantable device. In some embodiments, the device may be sized to facilitate ease of transport, such as to fit in a user's pocket or purse. For example, the device may be incorporated into a card, a keychain, a fob, a pocketknife, or a coin. In some embodiments, the device may include a software component of another device, such as a personal computer, a tablet computer, a cellphone, or a smart watch. The device can be powered by any suitable mechanism including, but not limited to, batteries, solar power, kinetic power, powered derived from thermal couples, and/or power obtained by vibration.

The device 102 can include an alert mechanism 106 and a detection mechanism 116. The alert mechanism 106 and the detection mechanism 116 can be collocated in a single device, or provided over two devices. The alert mechanism 106 can provide a reminder to a patient to take a medication 124. For example, the alert mechanism 106 can provide a reminder at a particular time of the day at which the medication 124 is to be taken or after a certain interval since the medication 124 was last taken.

In some embodiments, the alert mechanism 106 can provide a visual notification, such as to provide a visual reminder to take the medication 124. The visual notification may include a display of an indicia 108 that matches an indicia 110 on the cap 112 or other feature of the medication receptacle 104, such as the label 120 or body 122. Examples of the indicia 108, 110 include shapes, colors, and/or symbols (which can include text strings of letters or words). Matching indicia 108 and 110 may assist a patient in locating a receptacle 104 for the medication 124 that is the subject of the reminder. In an illustrative example, the alert mechanism 106 may include a light emitting diode (LED) or a display capable of producing a wide range of different colors that correspond to a given color on some part of the receptacle 104. In some embodiments, a display may be included separately from the alert mechanism and/or may display other information in addition to, or instead of, a reminder to take a medication 124. As an illustrative example, the device 102 may include a touchscreen display user interface through which a user may configure the device 102 and/or receive other information, such as information about the medication 124 and/or other healthcare details for the user.

In some embodiments, the alert mechanism 106 can provide an audible notification. For example, the alert mechanism may include a speaker capable of making a sound to remind a patient to take medication 124. The speaker may be tunable to cater to users with auditory impairment, such as altering a frequency of the audible notification for individuals with a narrower range of audible tones and/or increasing a volume of the audible notification for those with difficulties hearing lower volume sounds. Illustrative examples of audible notifications include beeps, tones, speech, and/or music. The alert mechanism 106 may be programmable to allow a user to record and/or otherwise provide a customized audible notification.

In some embodiments, the alert mechanism 106 can provide a tactile notification. For example, the alert mechanism 106 can include a vibration system capable of vibrating a part or a whole of the device 102, such as to provide a physical stimulus if and when the device is worn by a user or in contact with the user. Any one of the notifications described herein (e.g., visible notifications, audible notifications or tactile notifications) can be used individually and/or in combination with other notifications or types of notifications. In some embodiments, a same type of notification can be provided in different manners to indicate different meanings. As an illustrative example, the alert mechanism 106 may cause the device 102 to provide vibrating pulses in pairs to indicate that a user should take two pills instead of one. In general, the device 102 may be configured to accommodate different varieties of medication regimens and/or dosage.

In embodiments, the device 10 utilizes near field communication as part of the detection mechanism 116. For example, the detection mechanism 116 may detect a radio-frequency identification (RFID) tag 114 or other item, such as a marker, that can be used for identification within a certain distance of the detection mechanism 116. As illustrative examples, the certain distance may include a distance that corresponds to an item having the tag 114 coming into contact with the device 10, coming within a distance threshold of the device (such as 1 mm), or being within a distance range from the device (such as between 0 mm and 20 mm). The tag 114 may be part of a cap 112, a label 120, a body 122, or other feature of the receptacle 104. Accordingly, the detection mechanism 116 can detect if the receptacle 104 is near the device 102. The detection mechanism 116 can detect such proximity in any suitable manner. For example, the detection mechanism 116 can wirelessly detect the tag 114, as at 118, using RFID or other wireless near field communication technology. Although wireless near field communication technology is one option, proximity may be detected using any suitable technology, including scanning bar codes, a plug-in/socket arrangement, and/or any other communication method between nearby objects.

In embodiments, the system 100 provides a mechanism for tracking a user's consumption of mechanism 124. For example, each time the tag 114 is detected may correspond to another instance of the patient taking the medication 124.

In some embodiments, a reminder provided by the alert mechanism 106 may be persistent. As illustrative examples, a visible, flashing light notification may continue flashing until deactivated, or an audible notification may repeat at recurring intervals until deactivated. In some aspects, the notification may persist until a user has indicated that a medication 124 has been administered, such as by detection of a tag 114 associated with a medication receptacle 104 for the medication 124.

In some embodiments, the device 102 can execute other functions in addition to—or as an alternative to—deactivating a reminder in response to detecting a tag 114. Examples of some such functions are described in greater detail with respect to subsequent figures herein.

Figure 2:
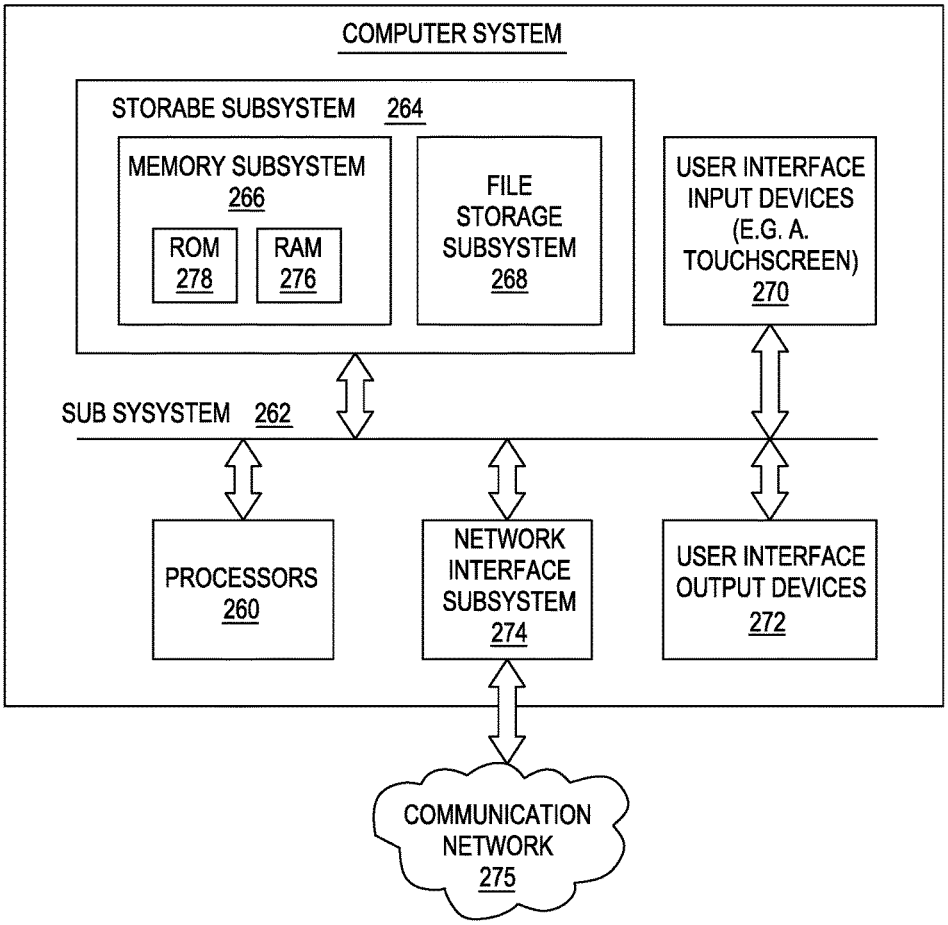
FIG. 2 is a simplified block diagram of an exemplary computer system in accordance with at least one embodiment.

FIG. 2 is a simplified block diagram of an exemplary computer system 200 that can be used in accordance with embodiments described herein. The computer system 200 typically includes at least one processor 260 which communicates with a number of peripheral devices via a bus subsystem 262. These peripheral devices may include a storage subsystem 264, comprising a memory subsystem 266 and a file storage subsystem 268, user interface input devices 270, user interface output devices 272, and a network interface subsystem 274. Network interface subsystem 274 provides an interface to a communication network 275 for communication with other systems, computers, databases, or the like.

The processor 260 performs the operation of the computer systems 200 using execution instructions stored in the memory subsystem 266 in conjunction with any data input from an operator. Such data can, for example, be input through user interface input devices 270, such as the graphical user interface. Thus, processor 260 can include an execution area into which execution instructions are loaded from memory. These execution instructions will then cause processor 260 to send commands to the computer system 200, which in turn control the operation of the container control electronics. Although described as a "processor" in this disclosure and throughout the claims, the functions of the processor may be performed by multiple processors in one computer or distributed over several computers.

User interface input devices 270 may include a keyboard, pointing devices such as a mouse, trackball, touch pad, or graphics tablet, a scanner, foot pedals, a joystick, a touchscreen incorporated into the display, audio input devices such as voice recognition systems, microphones, and other types of input devices. In general, use of the term "input device" is intended to include a variety of conventional and proprietary devices and ways to input information into the computer system. Such input devices will often be used to download a computer executable code from a computer network or a tangible storage media embodying steps or programming instructions for any of the methods of the present invention.

User interface output devices 272 may include a display subsystem, a printer, a fax machine, or non-visual displays such as audio output devices. The display subsystem may be a cathode ray tube (CRT), a flat-panel device such as a liquid crystal display (LCD), a projection device, or the like. The display subsystem may also provide non-visual display such as via audio output devices. In general, use of the term "output device" is intended to include a variety of conventional and proprietary devices and ways to output information from the computer system to a user.

Storage subsystem 264 stores the basic programming and data constructs that provide the functionality of the various embodiments. For example, database and modules implementing the functionality of embodiments described herein may be stored in storage subsystem 264. These software modules are generally executed by processor 260. In a distributed environment, the software modules may be stored in a memory of a plurality of computer systems and executed by processors of the plurality of computer systems. Storage subsystem 264 typically comprises memory subsystem 266 and file storage subsystem 268.

Memory subsystem 266 typically includes a number of memories including a main random access memory (RAM) 276 for storage of instructions and data during program execution and a read only memory (ROM) 278 in which fixed instructions are stored. File storage subsystem 268 provides persistent (non-volatile) storage for program and data files, and may include a hard disk drive, re-writable non-volatile memory chips (such as Flash memory), a floppy disk drive along with associated removable media, a Compact Digital Read Only Memory (CD-ROM) drive, an optical drive, DVD, CD-R, CD-RW, or removable media cartridges or disks. One or more of the drives may be located at remote locations on other connected computers at other sites coupled to the computer system. The databases and modules implementing the functionality of the present invention may also be stored by file storage subsystem 268. The file storage subsystem may have directory and file descriptions for accessing the files, or it may store data without descriptions and rely on the databases and modules of the system to locate the data.

Bus subsystem 262 provides a mechanism for letting the various components and subsystems of the computer system communicate with each other as intended. The various subsystems and components of the computer system need not be at the same physical location but may be distributed at various locations within a distributed network. Although bus subsystem 262 is shown schematically as a single bus, alternate embodiments of the bus subsystem may utilize multiple busses.

The computer system 200 itself can be of varying types including a personal computer, a portable computer, a workstation, a computer terminal, a network computer, a module in a circuit board, a mainframe, or any other data processing system. Due to the ever-changing nature of computers and networks, the description of the computer system depicted in FIG. 2 is intended only as a specific example for purposes of illustrating one embodiment. Many other configurations of the computer system are possible having more or less components than the computer system depicted in FIG. 2.

Figure 3:
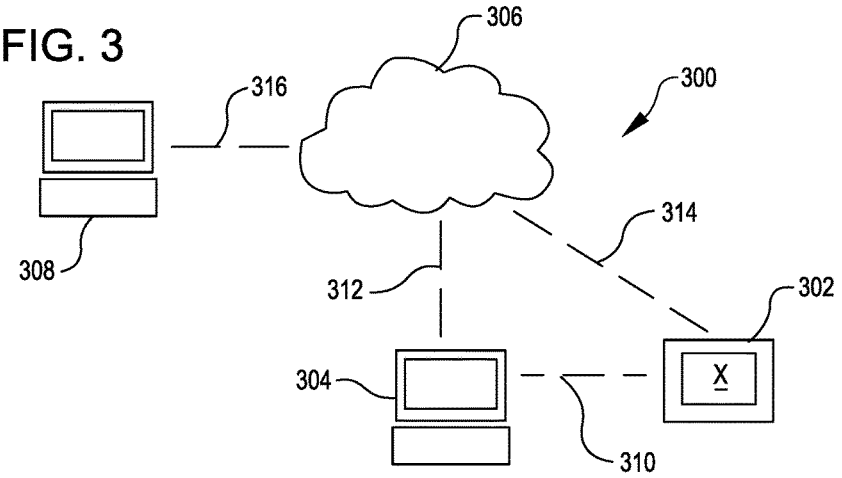
FIG. 3 is a schematic diagram depicting an illustrative system in which techniques herein may be implemented in accordance with at least one embodiment.

FIG. 3 is a schematic diagram depicting an illustrative system 300 in which techniques herein may be implemented in accordance with at least one embodiment. The system 300 can include a medication alert device 302, such as the medication alert device 102 described above with respect to FIG. 1. The device 302 can include a computer (e.g., such as the computer 200 of FIG. 2) and/or the device 302 may communicate with a computer that is separate from the device 302, such as a user computer 304 or a third party computer 308. The user computer 304 may be a computer (e.g., such as the computer 200 of FIG. 2) operated by a user of the device 302. The third party computer 308 can be a computer (e.g., such as the computer 200 of FIG. 2) operated by a healthcare provider, a pharmacy, a research institution, or any other party of relevance with respect to the user's utilization of the device 302.

The device 302 may communicate, as at 310, with the user computer 304. Communication can include sending and/or receiving information. The user computer 304 can, in turn, communicate with third party computers 308, such as at 312 and 316 via a network 306, such as the network 275. In some aspects, the device 302 can communicate directly with a third party computer 308 via the network 306, as at 314 and 316. The device 302 may communicate by any suitable manner including, but not limited to, wired communication or wireless communication such as near field communication, Bluetooth, WiFi, cellular radio standards, or other wireless protocols.

Figure 4:
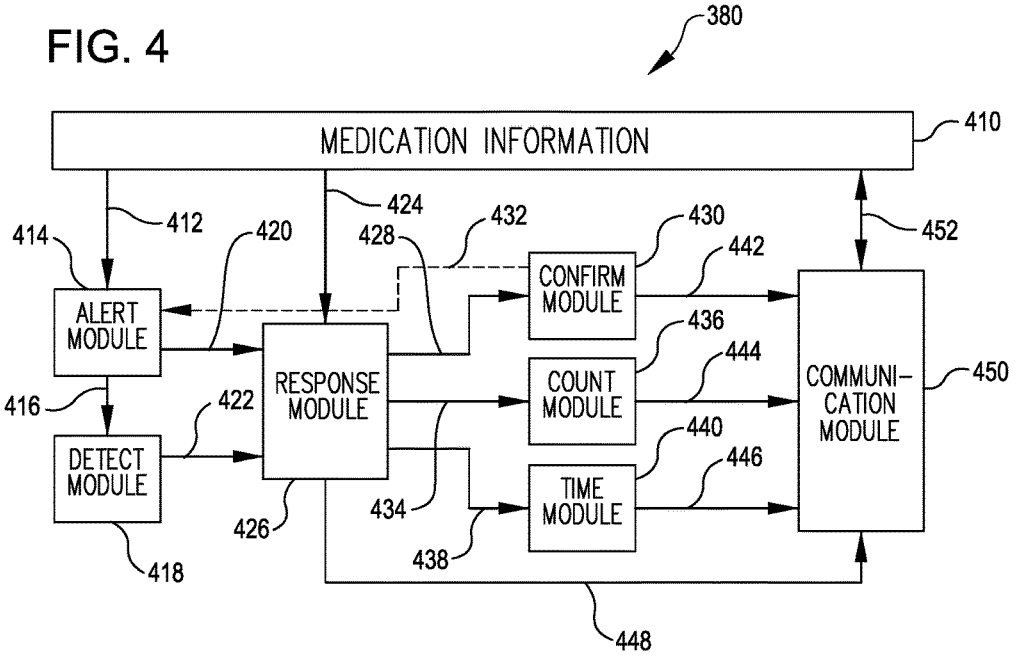
FIG. 4 schematically illustrates a plurality of modules that may carry out embodiments.

FIG. 4 schematically illustrates a plurality of modules 380 that may carry out embodiments. The modules 380 may be software modules, hardware modules, or a combination thereof. If the modules are software modules, the modules will be embodied on a computer readable medium and processed by a processor 260 in any of computer systems of the present disclosure.

At least some of the modules 380 may utilize medication information 410. For example, the medication information 410 may be stored in a storage subsystem 264 of any one of the computers 200 described herein. The medication information 410 may include, but is not limited to, names of medications associated with a user of a medication alert device, dosage information for medications, indicia associated with medications, tags associated with medications, administration timing for medications, quantities of medication for a user to take (e.g., number of pills), number of refills a patient has on file with a pharmacy for medications, whether a doctor notification or supplemental prescription is required for additional refills of any medications, a patient's age, a patient's gender, conditions that a patient has been diagnosed with, an area in which the patient lives, a pharmacy that the patient uses, and/or information about the patient's healthcare providers.

An alert module 414 can utilize medication information 410, such as at 412. The alert module 414 can trigger reminders for a patient to take a medication. For example, the alert module 414 may control an alert mechanism 106 based on medication information 410, such as timing information or indicia associated with the medication.

A detect module 418 can control detection performed by a medication alert device. For example, the detect module 418 can operate a detection mechanism 116 of a device 102. The detect module 418 may activate the detection mechanism 116 in response to information received from the alert module, as at 416, such as that an alert has been activated. Such an arrangement may reduce a power consumption by the detection mechanism 116. The detect module 418 may determine which tag 114, if any, is in proximity to the device 102.

The response module 426 can determine a response to information received from the detect module 418 at 422, information received from the alert module 414 at 420, medication information 410 accessed at 424, or any combination thereof. For example, the response module 426 may process and/or transfer information to other modules, such as at 428, 434, 438, and/or 448. The response module 426 may determine information to send to other modules, based on information received by the response module. For example, the response module may send information relating to one type of medication to one subset of modules and send information relating to a different medication to a different subset of modules.

A confirm module 430 can determine if a medication referenced in a reminder issued by the alert module is the same as the medication corresponding to a detection made by the detect module 418. For example, the confirm module 430 may receive information (e.g., at 428 from the response module 426) that an alert was activated to remind a patient to take aspirin from a first bottle and that the detect module 418 detected a tag for a bottle associated with aspirin. The confirmation module 430 may provide a confirmation that the selected bottle corresponds to the medication of the reminder, in this case, aspirin. In some aspects, the confirmation module 432 can communicate with the alert module 414 (e.g., at 432), such as to deactivate a reminder as a way of providing a confirmation that the medication of the detected bottle and the medication of the reminder match. In another illustrative example, the confirm module 430 may receive an indication that an alert was sent to remind a patient to take ibuprofen and a subsequent detection was associated with a bottle for aspirin. The confirmation module 430 may provide a warning that the medication of the reminder and the medication of the detected bottle do not match.

A count module 436 can generate information based on a number of times detections have been made. For example, the count module 436 can receive information, as at 434, about the number of times a tag 114 for a particular medication receptacle 104 has been detected. The count module 436 may determine an amount of medication 124 remaining in a particular medication receptacle 104 by subtracting a number of times an associated tag 114 has been detected from an initial amount of the medication 124 determined from the medication information 410.

A time module 440 can determine timing information associated with other operations described herein. For example, the time module may receive, as at 438, information about when an alert was triggered and when a matching detection was made. The time difference may be used to analyze and/or adjust the timing of future reminders and/or other actions.

A communication module 450 can coordinate communication between modules 380 and/or other components described herein. To this end, the communication module may receive information from the confirm module 430, as at 442, the count module 436, as at 444, the time module 440, as at 446, the response module 426, as at 448, medication information 410, as at 452, or any combination thereof. In an illustrative example, the response module 426 can determine that count information from module 436 should be communicated from the device 302 by the communication module 450 to another device, such as a user computer 304 and/or a third party computer 308. More specifically, medication information 410 may indicate that a particular medication receptacle 104 includes three pills, the detect module 418 may detect that the medication receptacle 104 was brought into proximity with the medication alert device 102, the response module 426 may forward the information to the count module 436, the count module 436 may calculate that two pills remain in the medication receptacle 104 based on the detection and previous count, the response module 426 may cause the information to be communicated via the communication module 450 to update the medication information 410 with the new count of two pills, and the response module 426 may cause information to be communicated via the communication module 450 to a third party computer 308 of a pharmacy to automatically request a refill of the medication.

Medication alert devices such as described herein (e.g., device 302) can include additional functionality which may be facilitated by the communication module 450 communicating between the device 302 and other electronic devices, such as computers 200. For example, information associated with the device 302 may be conveyed as electronic messages in the form of email, social networking sites, conventional mail, phone calls, voicemail messages, messaging services, text messaging, short message service, and/or multimedia messaging service. Such information may be provided to a user, a healthcare provider, pharmacy, an insurance provider, a research institution, other parties, and/or any combination thereof. For example, electronic messages may be utilized to: remind a user to request a refill, request a new prescription, and/or pick up a completed prescription; notify a user that a prescription has been filled at a pharmacy, that new alternative drugs are available, that follow-up appointments with healthcare providers are needed or scheduled, that test results are available, the costs associated with further prescriptions or appointments; inform a user about relevant and contextual information based upon weather and/or environmental conditions (e.g., if a patient has a respiratory condition, there is a smog alert in the area); and/or facilitate communication between the physician, user, pharmacy, insurance provider, research institute, and/or other parties.

In some aspects, the communication module 450 can facilitate communication between the device and other sensors and/or medical devices. Such communication may permit data about the patient's physiological conditions to be correlated with the patient's medication consumption history, permit detected physiological conditions of the patient to determine adjustments to dosing and/or timing of a medication regimen (e.g., by changing the timing and/or content of reminders and/or information provided to a patient), and/or permit information relevant to a patient's condition and/or physiological state to be communicated to the patient and/or another interested party (e.g., such as an advertisement for a product that may treat symptoms that the patient is experiencing, a recommendation and/or contact information or interface to contact a medical provider about the patient's physiological state, or graphical diagnostic information visible to the patient and a healthcare provider to facilitate discussion of the condition). Non-limiting, non-exclusive, examples of other sensors and/or medical devices that may be utilized in communication with or otherwise in conjunction with the device include: glucose monitors (e.g., which may detect a drop in blood sugar for a patient and shorten an interval before the patient's next reminder to take an insulin shot), accelerometers, gyroscopes, vibration sensors, thermometers or other temperature sensors, potentiometers, ohmmeters, voltmeters, light sensors, force sensors, infrared proximity sensors, pressure sensors, pulse sensors, humidity sensors, tilt sensors, magnetometers, blood pressure monitors, smart inhaler devices, pedometers, pulse monitors, prosthetics, implanted devices, pacemakers, CSF flow shunts, muscle relaxant pumps, etc.

In embodiments, the communication module 450 can communicate with other modules and/or other devices to update the medication information 410. For example, the communication module 450 may receive a new drug regimen to update information about medications included in the medication information 410. The communication module 450 may allow medication information 410 for a given patient be updated via any wireless standard or physical connection to the device at a pharmacy, healthcare provider, or user computer. In some embodiments, updates may be received by reading a medium imbedded with a wireless standard. As an illustrative example, a mail-order prescription may include a) bottle 104 with a cap 112 having a detectable tag 114, and b) a card with an RFID chip that can be read by the device 102 in order to update the device programming to function with the new bottle 104. The device 102 may have a designated "synching" interface to initiate an update, such as a button physically integrated into the device or appearing in a display of the device 102. The communication module 450 may interface with an optical reader configured to read print on a label on a medication receptacle in order to update medication information 410.

In some aspects, the response module 426 may compare newly received programming instructions to determine if they are more current that currently maintained instructions. The response module 426 may prevent newly received programming instructions from overwriting existing programming instructions if the newly received instructions are older or outdated, relative to the existing programming instructions. In some embodiments, the response module 426 can respond to updated medication information 410 communicated via the communication module 450 by checking if the newly updated medication information 410 corresponds to a patient associated with the medication alert device. If information in the update is not designated for the associated patient, the response module 426 may prevent the update from occurring.

Figure 5:
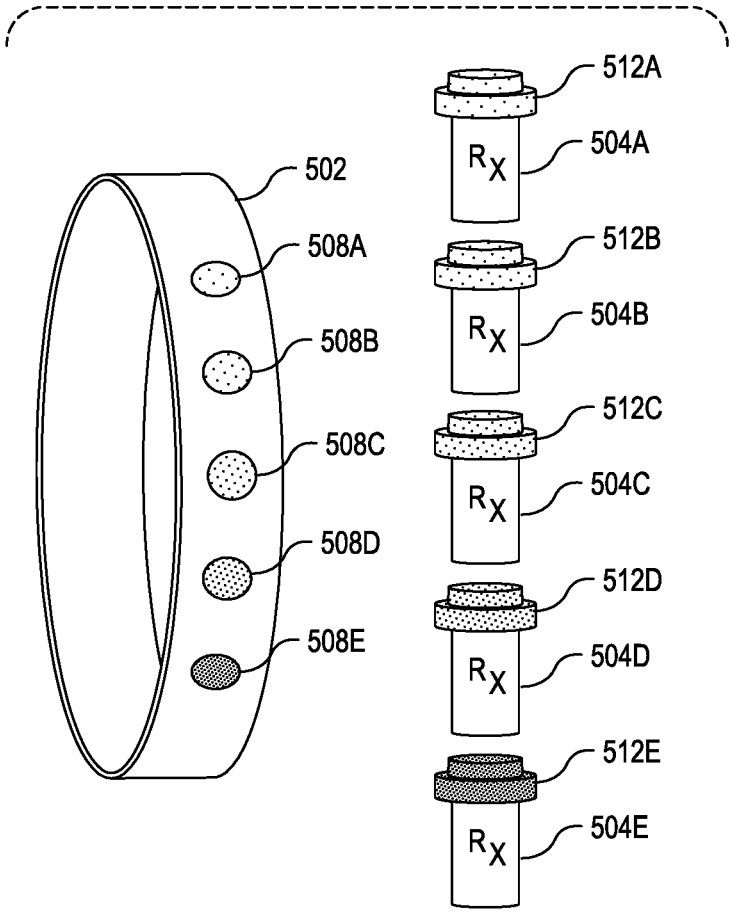
FIG. 5 is a schematic diagram showing an example of a medication alert device and corresponding features of multiple medication receptacles in accordance with at least one embodiment.

FIG. 5 is a schematic diagram showing an example of a medication alert device 502 and corresponding features of multiple medication receptacles 504 in accordance with at least one embodiment. The device 502 can include a plurality of different color lights 508A-508E, which may each correspond to a different colored cap 512A-512E of different medication receptacles 504A-504E. The lights 508 can provide a simple indicia to indicate which medication corresponds to a particular light. For example, the blue light 508B may flash when it is time for a user wearing the device 502 to take a medication contained in the medication receptacle 504B having the blue lid 512B. The blue light 508B may persistently flash to provide a reminder to take the medication until the blue lid 512B is removed from the receptacle 504B and brought into proximity of the device 502. The device 502 may additionally vibrate or emit a sound to draw extra attention to the flashing light 508B. When the blue lid 512B is brought into proximity with the device 502, the device 502 may detect the proximity and deactivate the flashing blue light 508B.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A system comprising:

a plurality of medication receptacles, each medication receptacle of the plurality having an identifier that includes a shape and/or color associated with the medication receptacle or a cap of the medication receptacle; and a device comprising a plurality of lights, each light of the plurality of lights matching a shape and/or color of an identifier of a medication receptacle of the plurality of medication receptacles, the device configured to activate one of the lights of the plurality when a reminder is due to a patient to take a medication associated with the medication receptacle having the identifier with the shape and/or color matching the light.

2. The system of claim 1, wherein the device is further configured to deactivate the activated light.

3. The system of claim 2, wherein the device is further configured to deactivate the activated light in response to the device detecting the medication receptacle and/or cap with the identifier having the shape and/or color matching the activated light.

4. The system of claim 3, wherein the device further comprises a sensor configured for respectively detecting the medication receptacles and/or caps associated with the medication receptacles.

5. The system of claim 4, wherein the device is configured to deactivate the activated light in response to the medication receptacle and/or cap with the identifier having the shape and/or color matching the light being detected by the sensor of the device.

6. The system of claim 4, wherein the sensor is configured to detect respective medication receptacles and/or caps by detecting the respective medication receptacles and/or caps via near field communication.

7. The system of claim 4, wherein the sensor is configured to detect respective medication receptacles and/or caps by detecting the respective medication receptacles and/or caps via an optical reader.

8. The system of claim 7, wherein the sensor is configured to detect respective medication receptacles and/or caps by detecting the respective medication receptacles and/or caps via a bar code scanner.

9. The system of claim 4, wherein the sensor is configured to respectively detect a medication receptacle and/or cap from among the medication receptacles and/or caps by detecting the medication receptacle and/or cap based at least in part on engagement between a plug and a socket, wherein the plug is associated with one of (i) the medication receptacle and/or cap and (ii) the sensor and the socket is associated with the other one of (i) the medication receptacle and/or cap and (ii) the sensor.

10. The system of claim 4, wherein the device further comprises a response mechanism configured to determine and/or communicate information based at least in part on the device detecting the medication receptacles and/or caps.

11. The system of claim 10, wherein the information includes at least one of:

an amount of time between activating the alert and detecting a medication receptacle and/or cap;

an amount of medication remaining in a specific medicine receptacle, the amount being based at least in part on a number of times the specific medication receptacle and/or cap associated with the specific medication receptacle has been detected; or information communicated to at least one of a user, a healthcare provider, or a computer;

an amount of time until a next alert activation;

an amount of time elapsed from a previous alert activation, a previous detection, and/or a previous alert deactivation; or information about a medication from a particular medication receptacle for which the particular medication receptacle and/or cap associated with the particular medication receptacle has been detected.

12. A system comprising a device comprising:

a display; and an alert mechanism configured to:

receive or generate a first indication that a first reminder is due to a user to take a first medication associated with a first medication receptacle associated with a first indicia that comprises a first unique color, a first unique shape, or a first unique combination of shape and color;

cause the display to show the first indicia in response to the first indication being received or generated;

receive or generate a second indication that a second reminder is due to the user to take a second medication associated with a second medication receptacle associated with a second indicia that differs from the first indicia and comprises a second unique color, a second unique shape, or a second unique combination of shape and color; and cause the display to show the second indicia in response to the second indication being received or generated.

13. The system of claim 12, wherein the device comprises at least one of a watch, a bracelet, a necklace, a garment, or a device configured to be worn by the user.

14. The system of claim 12, wherein the display comprises a screen configured to selectively show indicia that vary by at least one of shape or color.

15. The system of claim 12, wherein the display comprises a first light matching the first indicia and a second light matching the second indicia.

16. The system of claim 12, further comprising the first medication receptacle and the second medication receptacle.

17. A system comprising a device comprising:

a plurality of lights, each light of the plurality of lights matching a shape and/or color of an identifier of a plurality of identifiers, the device configured to activate one of the lights of the plurality when a reminder is due to a patient to take an action associated with an object associated with the identifier with the shape and/or color matching the light from among a plurality of objects.

18. The system of claim 17, wherein at least one object of the plurality of objects is a medication receptacle and the action associated therewith is taking a dose of medication from the medication receptacle.

19. The system of claim 18, further comprising the medication receptacle.

20. The system of claim 19, wherein the device is further configured to deactivate the activated light in response to the device detecting the object with the identifier having the shape and/or color matching the activated light.

* * * * *